US006666549B2

(12) United States Patent
Harada et al.

(10) Patent No.: US 6,666,549 B2
(45) Date of Patent: Dec. 23, 2003

(54) INK-JET RECORDING APPARATUS AND INK SUPPLY METHOD THEREIN

(75) Inventors: Shuhei Harada, Nagano (JP); Atsushi Kobayashi, Nagano (JP); Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 99 days.

(21) Appl. No.: 10/097,123

(22) Filed: Mar. 14, 2002

(65) Prior Publication Data

US 2002/0130932 A1 Sep. 19, 2002

(30) Foreign Application Priority Data

Mar. 15, 2001 (JP) ..... P2001-073848
Mar. 29, 2001 (JP) ..... P2001-095696

(51) Int. Cl.[7] ..... B41J 2/175
(52) U.S. Cl. ..... 347/85
(58) Field of Search ..... 347/84–87, 7, 347/89, 94

(56) References Cited

U.S. PATENT DOCUMENTS 5,963,237 A * 10/1999 Ikkatai et al. ..... 347/85
6,010,212 A * 1/2000 Yamashita et al. ..... 347/86
6,082,851 A * 7/2000 Shihoh et al. ..... 347/85

* cited by examiner

*Primary Examiner*—Stephen D. Meier
*Assistant Examiner*—An H. Do
(74) *Attorney, Agent, or Firm*—Sughrue Mion, PLLC

(57) ABSTRACT

The ink-jet recording apparatus according to the invention is provided with a recording head for jetting an ink droplet corresponding to print data, a main tank for supplying ink to the recording head and a subtank composed of upper and lower two tanks respectively connected to the main tank and the recording head and mutually communicating, the upper tank of the subtank is formed by an ink tank having an ink outlet for leading ink to the recording head, and the lower tank is formed by an ink tank having an ink inlet for leading ink from the main tank by pressure of a pump and elastically deformable according to the variation of internal pressure.

20 Claims, 9 Drawing Sheets

INK-JET RECORDING APPARATUS AND INK SUPPLY METHOD THEREIN

CROSS REFERENCE TO RELATED APPLICATIONS

The present application is based on Japanese Patent Applications No. 2001-73848 and No. 2001-95696, the entire contents of which are incorporated herein by reference.

BACKGROUND OF THE INVENTION

The present invention relates to an ink-jet recording apparatus provided with main and auxiliary two ink tanks (a main tank and a subtank) for supplying ink to a recording head and its ink supply method.

An ink-jet recording apparatus is generally provided with a recording head mounted on a carriage and moved in a direction of the width of recording paper and a paper feed device for relatively moving recording paper in a direction perpendicular to a direction in which the recording head is moved.

In such an ink-jet recording apparatus, printing is performed on recording paper by jetting an ink droplet from a recording head based upon print data.

A recording head that can jet each ink in black, yellow, cyan and magenta is mounted on a carriage, not only the printing of text by black ink but full color printing are enabled by varying a rate of jettings of each ink.

Therefore, ink cartridges that supply each ink to the recording head are arranged in the main body of the recording apparatus.

In a normal ink-jet recording apparatus, each ink cartridge in which ink in one of black, yellow, cyan and magenta is stored is mounted on a carriage and is moved together with the carriage.

In the meantime, for example, in this type of recording apparatus provided for an office or for service, an ink cartridge having large capacity in which the above-mentioned each ink is stored is not arranged on a carriage and is arranged on the main body of the recording apparatus to correspond to a relatively large quantity of printing.

A recording apparatus of a type that a main tank as an ink cartridge is arranged on the main body of the recording apparatus (a cartridge holder) and a subtank is arranged on a carriage on which a recording head is mounted is also provided. Ink is supplied from each main tank to each subtank via an ink supply tube and further, ink is supplied from each subtank to each recording head.

In the latest recording apparatuses, to enhance a recording rate, a carriage is moved at high speed.

In such a recording apparatus, the pressure of inside ink varies by the extension or the bending of an ink supply tube due to the acceleration or the deceleration of the carriage and the jetting of an ink droplet from a recording head is made unstable.

Therefore, an open type ink supply method of opening a subtank to the air, discharging the above-mentioned varied pressure from the opening and supplying ink stored in the subtank to a recording head according to difference in an ink head is adopted.

However, the open type ink supply method has the following problems. That is, the open type ink supply method has a problem that as the subtank is open to the air, bubbles are included in ink in the subtank when ink is supplied, a degree of the deaeration of ink supplied to the recording head cannot be guaranteed and satisfactory printing cannot be realized.

There is also a problem that as ink is supplied from the subtank to the recording head according to difference in a head of ink in the subtank, the height of the subtank is required to be sufficiently secured and the whole subtank is large-sized.

SUMMARY OF THE INVENTION

The invention is made to solve such technical problems and the object is to provide an ink-jet recording apparatus as well as ink supplying method in which satisfactory printing can be realized and the whole subtank can be miniaturized.

The ink-jet recording apparatus according to the invention made to achieve the object is provided with a reciprocating carriage; a recording head mounted on the carriage for jetting an ink droplet corresponding to print data; a main tank for supplying ink to the recording head; and a subtank mounted on the carriage and connected to the main tank and the recording head, the subtank including an upper tank having an ink outlet for leading ink to the recording head, and a lower tank communicating with the upper tank and having an ink inlet for leading ink from the main tank by pressure of a pump, wherein the lower tank is elastically deformable according to variation of an internal pressure thereof.

As the ink-jet recording apparatus according to the invention is configured as described above, ink in the main tank flows into the lower tank of the subtank according to pressure of a pump when ink is supplied and after the ink further flows from the lower tank into the upper tank, it is supplied from the upper tank to the recording head.

At this time, when the variation of pressure occurs in the lower tank (in ink in an ink supply tube connecting the main tank and the subtank), the lower tank is elastically deformable according to the variation of the internal pressure (the volume) and the variation of the pressure (the volume) is absorbed.

Therefore, as ink from the main tank can be supplied to the recording head according to a closed type ink supply method, bubbles are not included in ink in the subtank when ink is supplied differently from heretofore, a degree of the deaeration of ink is guaranteed and satisfactory printing can be realized.

Also, as ink can be supplied from the subtank to the recording head by negative pressure provided on a side of the recording head, the height of the subtank can be reduced and the whole subtank can be miniaturized.

In this case, it is desirable that at least a part of a tank wall formed on the lower tank is made of an elastic film.

As the tank wall is configured as described above, a part of the tank wall is elastically deformable according to the variation of pressure in the lower tank when the pressure in the lower tank varies.

The elastic film is formed by a material which is flexible, resistant to ink and impermeable to moisture and gas.

As the elastic film is configured as described above, the subtank having the elastic film impermeable to moisture and gas and excellent in flexibility and resistance to ink can be acquired.

It is desirable that a check valve is arranged in the upper tank and opened by negative pressure provided on a side of the recording head.

As the check valve is configured as described above, negative pressure is generated on the side of the recording head, the check valve is opened and ink can be supplied from the main tank to the recording head via the subtank.

It is desirable that the ink jet recording apparatus is further provided with an ink amount detecting device detectable an ink amount in the subtank based upon an amount of elastic deformation thereof.

As the ink amount detecting device is configured as described above, an amount of the elastic deformation of the subtank is detected by the ink amount detecting device and the ink amount in the subtank is controlled.

Pneumatics generated by a pneumatic pump may be applied to the main tank so that ink is supplied to the main tank to the subtank.

As the ink-jet recording apparatus according to the invention is configured as described above, ink can be sequentially supplied from the main tank to the subtank, exceeding printing and the throughput can be enhanced.

A diaphragm pump may be provided at an intermediate position between the main tank and the subtank for supplying ink from the main tank to the subtank according to increase or decrease of an internal volume of the diaphragm pump.

As ink in the main tank is supplied to the subtank by the diaphragm pump when ink is supplied because of such configuration, the main tank is not required to be pressurized in case ink is supplied from the main tank to the subtank, and an ink pack that can resist pressurization and a mechanism for controlling pressurization are not required.

Therefore, as the number of controlled elements can be reduced, a control system can be simplified.

As a pressure chamber is not required to be formed in the main tank, the structure of the main tank can be simplified.

Further, as the outside dimension of the main tank is reduced because no pressure chamber is required in the main tank, the whole recording apparatus can be miniaturized.

It is desirable that a plurality of the main tanks, a plurality of the subtanks and a plurality of the diaphragm pumps are provided.

Ink is supplied from each main tank to each subtank by each diaphragm pump because of such configuration.

In the recording apparatus with the above configuration, it is desirable that a plurality of pump drivers are provided, each of which has a link mechanism corresponding to the diaphragm pumps, wherein the pump drivers are driven by a common motor having a rotation shaft for selectively driving each diaphragm pump.

A motor is not required every diaphragm pump because of such configuration, the number of parts is reduced, the whole structure is simplified and the cost can be reduced.

It is desirable that coupling members are provided to an outer surface of the rotation shaft and the coupling members are selectively coupled to the link mechanisms of the pump drivers.

As the rotation shaft is configured as described above, the link mechanism is selectively coupled to the rotation shaft via each coupling member.

It is desirable that the coupling members are arranged at a predetermined interval in a circumferential direction and an axial direction of the rotation shaft.

As the rotation shaft is configured as described above, the link mechanism is selectively coupled to the rotation shaft via each coupling member located at a predetermined interval in the circumferential direction and the axial direction of the rotation shaft.

Further, it is desirable that each coupling member of the rotation shaft is provided as a driving intermittent gear; and the link mechanism of each pump driver includes a driven intermittent gear corresponding to each driving intermittent gear.

As the coupling member is configured as described above, the link mechanism is coupled to the rotation shaft by the engagement of intermittent gears.

The link mechanism includes a first link arranged in a direction of the outside diameter of the rotation shaft so as to be turned and having the driven intermittent gear at one end of the first link; and a second link turnably and swingably coupled to another end of the first link where the driven intermittent gear is not provided, wherein an internal volume of the diaphragm pump is increased or decreased in accordance with a turning and swing of the second link; and a common pivot part of the second link and the first link is urged by a spring in a direction in which the common pivot part approaches the diaphragm pump.

As the link mechanism is configured as described above, the intermittent gear of the rotation shaft and the intermittent gear of the first link are selectively engaged as a result of the following turning and an arbitrary diaphragm pump is selected when the rotation shaft in an initial state of pump selection is turned in a direction in which the second link separates from the diaphragm pump. In this case, as the rotation shaft is turned in a state in which the second link separates from the diaphragm pump, the internal volume of the diaphragm pump is not increased or decreased.

In the meantime, when the rotation shaft in an initial state of pump driving is turned in a direction in which the second link approaches the diaphragm pump, the intermittent gear of the rotation shaft and the intermittent gear of the first link are engaged as a result and the diaphragm pump is driven (ink is discharged). In this case, the diaphragm pump is contracted and the internal volume of the pump is decreased.

Also, when the rotation shaft is turned in a direction in which the second link separates from the diaphragm pump after the discharge of ink from the diaphragm pump, the diaphragm pump is driven (ink is sucked) as a result. In this case, the diaphragm pump is extended and the internal volume of the pump is increased.

It is desirable that a pin for regulating the turning and the swing of the second link is provided.

As the link mechanism is configured as described above, the turning/the swing of the second link is regulated by the pin.

It is desirable that a long hole fitted to the pin is provided to the second link.

As the link mechanism is configured as described above, the swing of the second link is regulated by fitting the pin and the long hole.

The motor is rotatable in both the normal and reverse directions of rotation.

As the motor is configured as described above, pump selecting operation and pump driving operation are executed by the normal rotation and the reverse rotation of the motor.

It is desirable that the diaphragm pump is selectively driven by the normal or reverse rotation of the motor to thereby supply ink from the main tank to the subtank.

Owing to such configuration, the selecting and driving operation of the diaphragm pump is executed by the engagement of the intermittent gears according to the normal rotation and the reverse rotation of the motor.

Therefore, as the selecting and driving operation of each diaphragm pump can be realized by the normal rotation and the reverse rotation of the motor, the prompt supply of ink to each subtank can be realized.

In the meantime, there is provided a method for supplying ink from a main tank to a recording head via a subtank of an ink-jet recording apparatus provided with a reciprocating carriage, a recording head mounted on the carriage for jetting an ink droplet corresponding to print data, a main tank for supplying ink to the recording head and a subtank mounted on the carriage while connected to the main tank and the recording head, and having an upper tank and a lower tank mutually communicating therebetween, wherein when ink is supplied from the main tank to the recording head, the lower tank is elastically deformable according to a variation of internal pressure thereof.

Owing to such a method, as ink from the main tank can be supplied to the recording had according to a closed type ink supply method, an ink-jet recording apparatus in which bubbles are not included in ink in a subtank when ink is supplied as heretofore, a degree of the deaeration of ink is guaranteed and satisfactory printing is realized can be acquired.

Further, as ink can be supplied from the subtank to the recording head by negative pressure generated on the side of the recording head, an ink-jet recording apparatus in which the dimension in height of a subtank can be reduced and the whole subtank can be miniaturized can be acquired.

A pneumatic pump is arranged in the main tank; and pneumatics generated by the pneumatic pump are applied to the main tank so that ink is supplied to the main tank to the subtank.

Owing to such a method, as ink can be sequentially supplied from the main tank to the subtank, executing printing, the throughput can be enhanced.

A diaphragm pump is provided at an intermediate position between the main tank and the subtank for supplying ink from the main tank to the subtank according to increase or decrease of an internal volume of the diaphragm pump.

Owing to such a method, as ink in the main tank is supplied to the subtank by the diaphragm pump when ink is supplied, the main tank is not required to be pressurized in case ink is supplied from the main tank to the subtank, and ink pack resistant to pressurization and the mechanism for controlling the pressurization are not required.

Therefore, as the number of controlled elements can be reduced, a control system can be simplified.

Further, as the pressure chamber is not required to be formed in the main tank, the structure of the main tank can be also simplified.

DETAILED DESCRIPTION OF THE PREFERRED EMBODIMENTS

Figure 1:
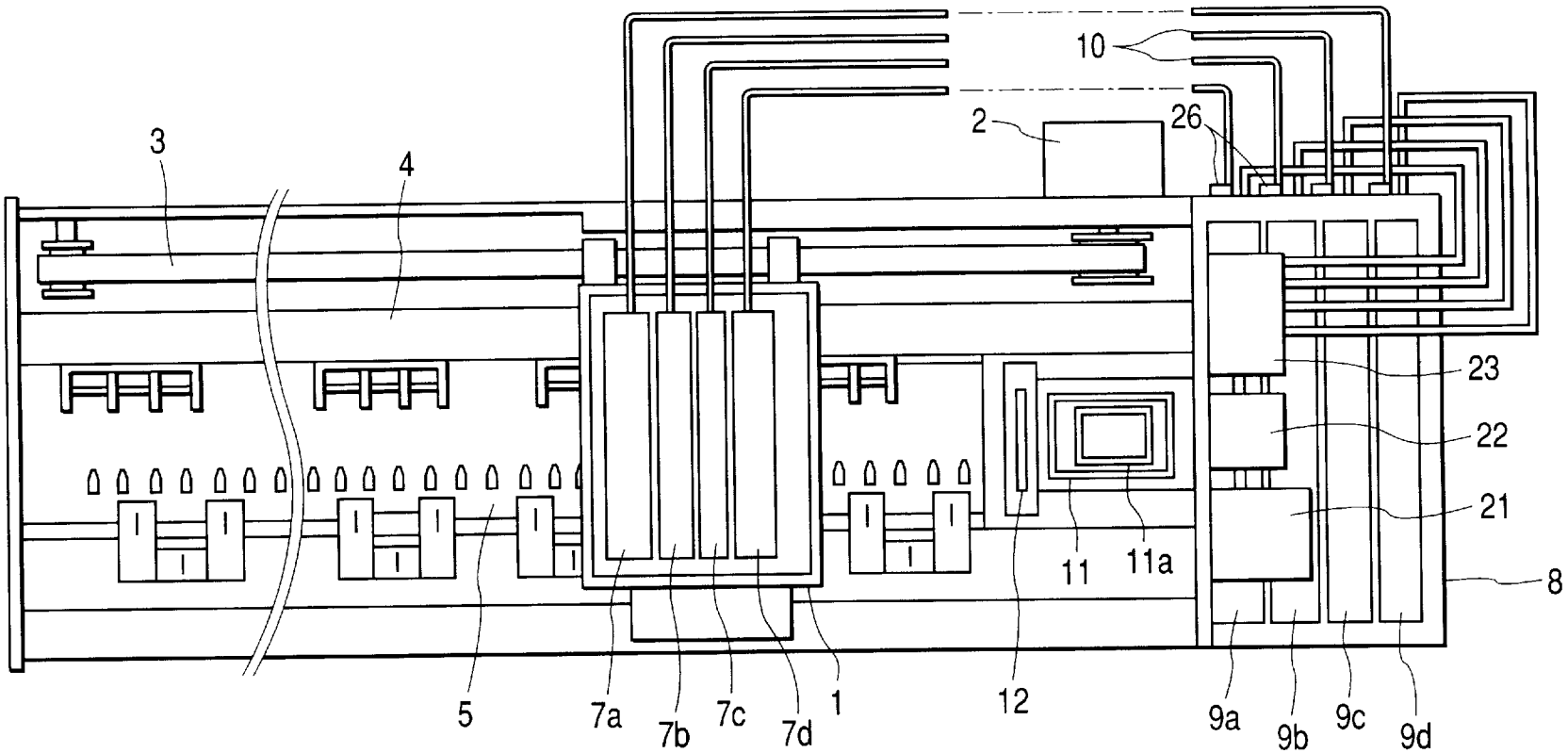
FIG. 1 is a plan view showing the basic configuration of an ink-jet recording apparatus equivalent to an embodiment of the invention.

An ink-jet recording apparatus to which the invention is applied and its ink supply method will be described based upon embodiments shown in the drawings below.

First, referring to FIG. 1, the ink-jet recording apparatus will be described. FIG. 1 is a plan view showing the basic configuration of an ink-jet recording apparatus equivalent to an embodiment of the invention.

A carriage denoted by a reference number 1 is installed on a timing belt 3 driven by a carriage motor 2. The carriage is configured so that it is guided by a guide member 4 and is reciprocated in a longitudinal direction of a paper feed member 5, that is, in a horizontal scanning direction which is a direction of the width of recording paper. An ink-jet recording head 6 (shown in FIG. 2 though it is not shown in FIG. 1) is installed at the bottom of the carriage 1 opposite to the paper feed member 5.

Further, subtanks 7*a* to 7*d* for supplying ink from a main tank described later to the recording head 6 are mounted on the carriage 1.

Four subtanks 7*a* to 7*d* are provided corresponding to each ink in black, yellow, magenta and cyan to temporarily store each ink inside. Each ink is supplied from main tanks 9*a* to 9*d* as an ink cartridge loaded on a cartridge holder 8 arranged in the main body of the recording apparatus respectively via ink supply tubes 10 made of flexible material.

The main tanks 9*a* to 9*d* as ink cartridge are formed so that the outer shapes are flat. The main tanks 9*a* to 9*d* are arranged in parallel with each other on the cartridge holder 8 so that the flat face of each main tank is opposite to a vertical face of the adjacent ones.

In the meantime, in a non-printing area (a home position) on a path on which the carriage 1 is moved, a capping device 11 that can seal the nozzle formation surface of the recording head 6 is arranged. A cap member 11*a* made of flexible material such as rubber that can seal the nozzle formation surface of the recording head 6 is arranged on the capping device 11.

When the carriage 1 is moved to the home position, the nozzle formation surface of the recording head 6 can be sealed by the cap member 11*a*.

This cap member 11*a* functions as a cover that seals the nozzle formation surface of the recording head 6 while the recording apparatus halts and prevents a nozzle aperture from drying. Although it is not shown in FIG. 1, one end of a tube in a suction pump (a tube pump) is connected to the cap member 11*a*. Cleaning operation is performed by so that negative pressure by the suction pump is applied to the recording head 6 and ink is sucked and exhausted from the recording head 6.

A wiping member 12 made of elastic material such as rubber is arranged next to a side of a printing area of the capping device 11 so that the nozzle formation surface of the recording head 6 can be wiped and cleaned if necessary.

Figure 2:
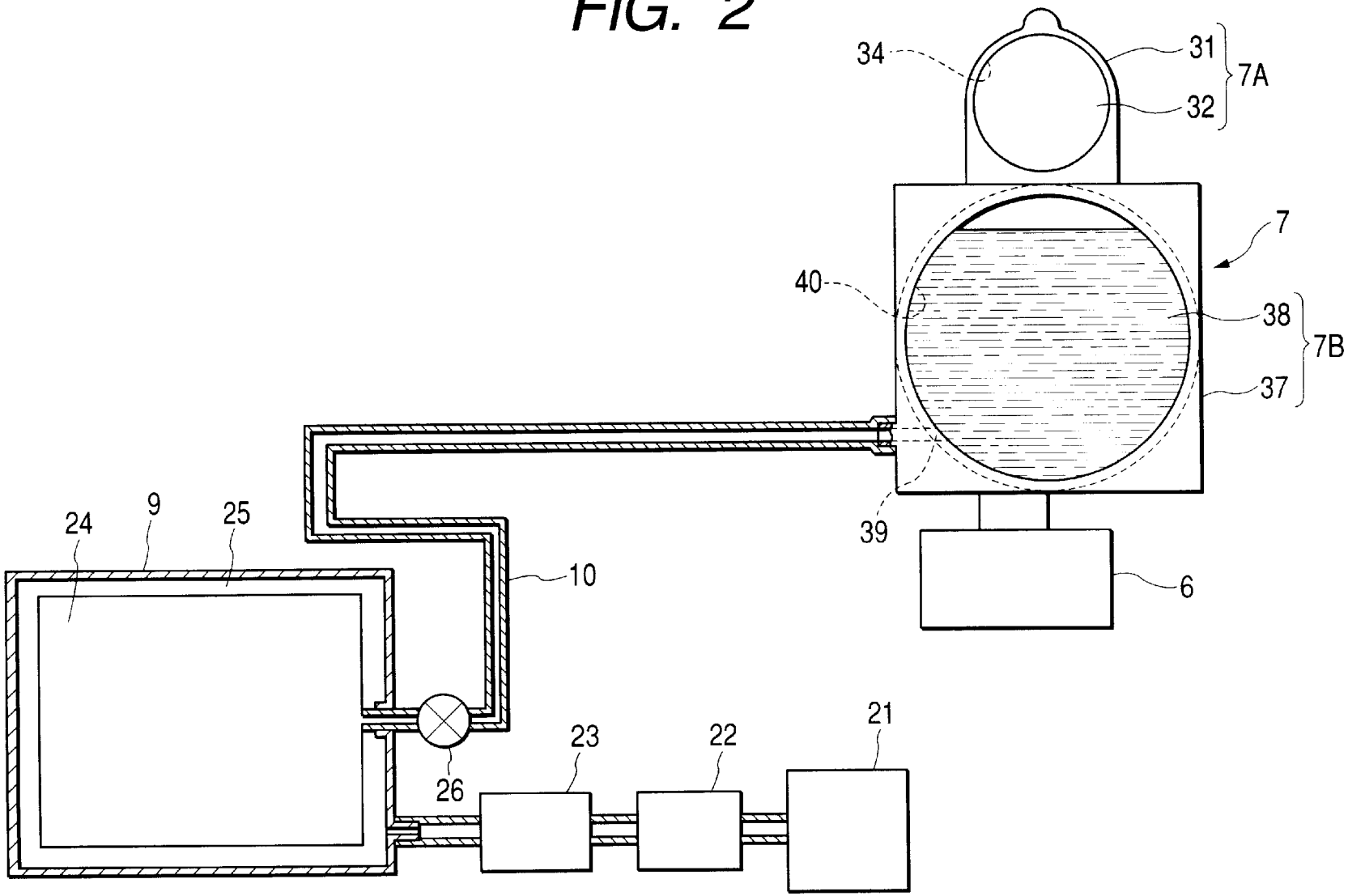
FIG. 2 is a schematic drawing showing an ink supply system from an ink cartridge to a recording head in the recording apparatus shown in FIG. 1.
Figure 3D:
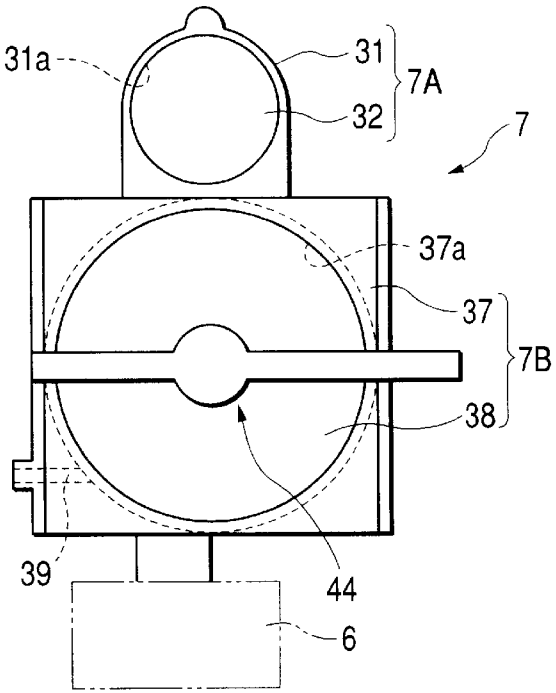
FIGS. 3A to 3D are respectively a left side view, a front view, a sectional view and a right side view showing a subtank of the ink-jet recording apparatus equivalent to the embodiment of the invention.
Figure 3C:
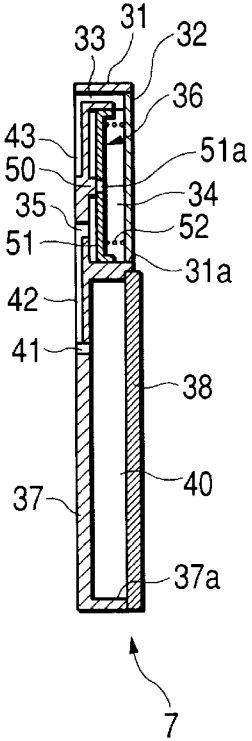
Figure 3B:
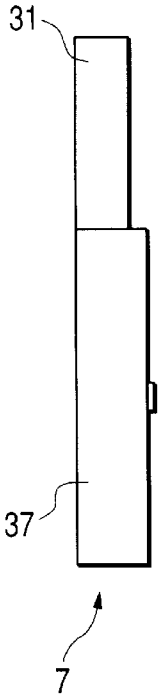
Figure 3A:
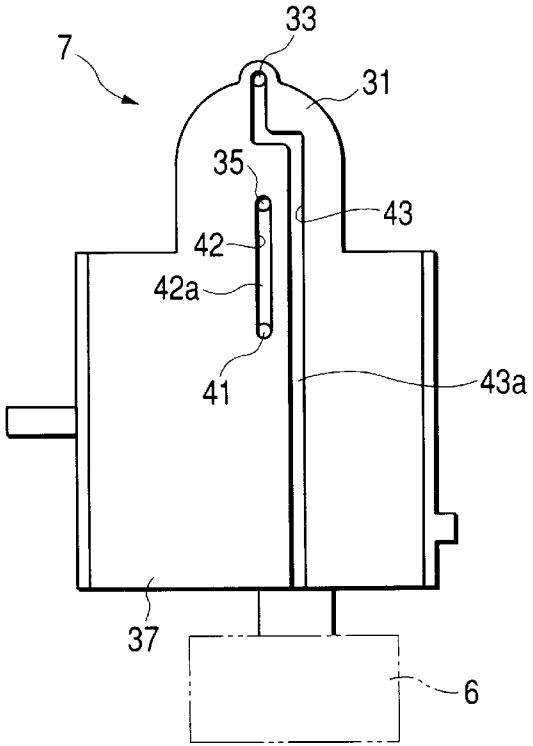

Next, referring to FIGS. 1 and 2, an ink supply system of the recording apparatus configured as described above will be described. FIG. 2 is a sectional view schematically showing the configuration of the ink supply system in the recording apparatus shown in FIG. 1, in FIG. 2, the same reference number is allocated to the same member as that shown in FIG. 1 and the detailed description is omitted.

As shown in FIG. 2, a reference number 21 denotes a pneumatic pump. Air pressurized by the pneumatic pump 21 is supplied to a pressure regulating valve 22 and further, is supplied to each main tank 9*a* to 9*d* (represented by a reference number 9 in FIG. 2) via a pressure detector 23.

The pressure regulating valve 22 has a function that keeps pneumatics applied to each main tank 9*a* to 9*d* in a predetermined range in a closed state when pneumatics pressurized by the pneumatic pump 21 exceed a predetermined value.

The pressure detector 23 has a function that detects pneumatics pressurized by the pneumatic pump 21 and controls the driving of the pneumatic pump 21.

That is, in case the pressure detector detects that pneumatics pressurized by the pneumatic pump 21 reach a predetermined pressure, it stops the driving of the pneumatic pump 21. In case the pressure detector 23 detects that pneumatics are equal to or smaller than the predetermined pressure, it drives the pneumatic pump 21.

Therefore, pneumatics applied to each main tank 9*a* to 9*d* are kept in a predetermined range by the above-mentioned repetition.

An ink pack 24 filled with ink and made of flexible material is housed in the outer case of the main tank 9 (the ink cartridge) as shown in FIG. 2. Space between the main tank 9 and the ink pack 24 forms a pressure chamber 25 and pressurized air from the pneumatic pump 21 via the pressure regulating valve 22 and the pressure detector 23 is supplied to the pressure chamber 25.

Owing to this configuration, pressure by pressurized air is applied to each ink pack 24 housed in each main tank 9*a* to 9*d* and ink flow under the predetermined pressure from each main tank 9*a* to 9*d* to each subtank 7*a* to 7*d* is generated.

Ink pressurized in each main tank 9*a* to 9*d* is supplied to each subtank 7*a* to 7*d* (represented by a reference number 7 in FIG. 2) mounted on the carriage 1 via each ink supply valve 26 and each ink supply tube 10.

Figure 4A:
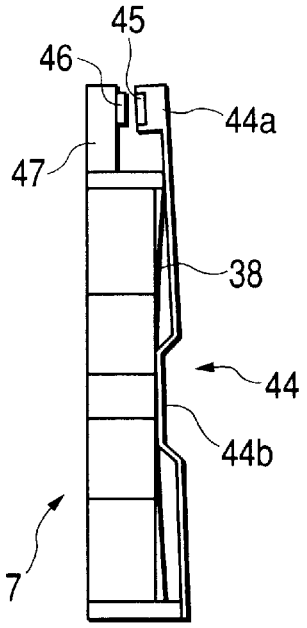
FIGS. 4A to 4C are plan views for explaining the operation of the ink amount detecting device for detecting the ink amount in the subtank shown in FIGS. 3A to 3D.
Figure 4B:
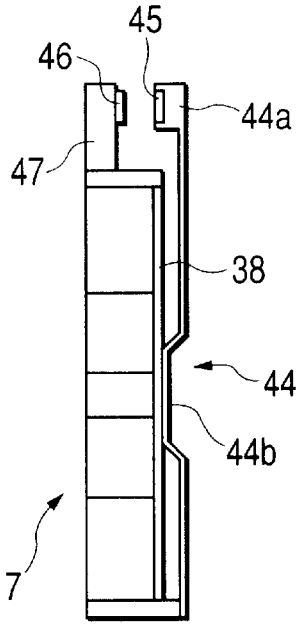
Figure 4C:
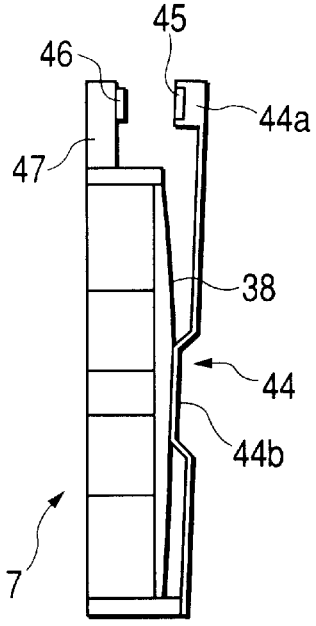

Next, referring to FIGS. 1 to 2, 3A to 3D and 4A to 4C, the subtank which is a main part of the invention will be described. FIGS. 3A to 3D are respectively a left side view, a front view, a sectional view and a right side view respectively showing the subtank of the ink-jet recording apparatus equivalent to the embodiment of the invention. FIGS. 4A to 4C are plan views for explaining the operation of the ink amount detecting device for detecting the ink amount in the subtank shown in FIGS. 3A to 3D.

The subtank 7 shown in FIGS. 1 to 2, 3A to 3D and 4A to 4C is provided with upper and lower two tanks 7A and 7B mutually communicating and is connected to the main tank 9 via the ink supply tube 10.

The tank 7A is composed of the box-type body 31 of the tank having a circular window 31*a* open to the right side and a planar circular tank wall 32 for closing the circular window 31*a* of the body 31, and is arranged over the recording head 6. An ink outlet 33 for leading ink to the recording head 6 and a cylindrical ink chamber 34 communicating with the ink outlet 33 are provided to the upper tank 7A. A distribution port 35 located under the ink outlet 33 and communicating with the ink chamber 34 is also provided to the tank 7A. A check valve 36 having a valve seat 50 protruded into the ink chamber 34 and opened by generating negative pressure on the side of the recording head 6 is arranged in the tank 7A.

The check valve 36 is provided with a planar circular valve element 51 (a thin film) having a through hole 51*a* in the center and a compression coil spring 52 that ordinarily applies spring to the valve element 51 in a direction in which the through hole 51*a* is closed. The check valve is configured so that when ink is jetted from the recording head 6, the valve element 51 can be moved in a direction in which the through hole 51*a* is opened against the spring of the compression coil spring 52 (in a direction in which the valve element separates from the valve seat 50).

The tank wall 32 is formed by a planar circular rigid film having resistance to ink and impermeable to moisture and gas.

The tank 7B is composed of the box-type body 37 of the tank having a circular window 37*a* open to the right side like the circular window 31*a* and a planar circular tank wall 38 for closing the circular window 37*a* of the body 37, and is arranged under the tank 7A. An ink inlet 39 for leading ink from the main tank 9 via the ink supply tube 10 and a cylindrical ink chamber 40 communicating with the ink inlet 39 for storing ink of a predetermined quantity are provided to the lower tank 7B. A distribution port 41 located above the ink inlet 39 and communicating with the ink chamber 40 is also provided to the tank 7B.

In the ink chamber 40, a filter (not shown) for picking up dust in ink is arranged so that the filter closes the distribution port 41.

A first ink passage 42 communicating with both distribution ports 35 and 41 and extended perpendicularly is provided in the center in a direction of the width of a left side end face in both tanks 7A and 7B. In both tanks 7A and 7B, a second ink passage 43 communicating with the ink outlet 33 and the recording head 6 and extended horizontally and vertically is provided.

A part of a passage wall of both ink passages 42 and 43 is respectively formed by transparent plastic films 42*a* and 43*a*.

The tank wall 38 is formed by a planar circular thin film having flexibility and resistance to ink, impermeable to gas and moisture and elastically deformable according to the variation of internal pressure in the ink chamber 40. The tank wall 38 is configured so that when the pressure of ink in the ink supply tube 10 varies, the tank wall 38 is elastically deformed according to the variation of pressure in the tank 7B (the volume of the tank 7B) and the variation of the pressure (the variation of the volume) is absorbed.

A detecting piece 44 extended horizontally through the center of the tank wall 38 is elastically held at the front end of a right side end face in the tank 7B. A magnet holding part 44*a* for holding a magnet 45 outside the subtank 7 and a deformed amount transmitting part 44*b* bonded to the center of the tank wall 38 are provided to the detecting piece 44 as shown in FIGS. 4A to 4C.

A magnetoelectric transducing element 46 such as hall element corresponding to the magnet 45 is arranged at the rear end of the left side end face in the tank 7B via an element fitting piece 47.

Hereby, the ink amount detecting device for causing the magnetoelectric transducing element 46 to generate electric output according to the quantity of magnetic lines of force by the magnet 45 according to an amount of elastic deformation of the tank wall 38 is configured.

Therefore, in case the ink amount in the subtank 7 decreases, the tank wall 38 is elastically deformed inside the lower tank 7B as shown in FIG. 4A, as a result, the detecting piece 44 is elastically deformed as shown in FIG. 4A from a position shown in FIG. 4B and the magnet 45 approaches the magnetoelectric transducing element 46. In the meantime, in case the ink amount in the subtank 7 increases, the tank wall 38 is elastically deformed outside the lower tank 7B as shown in FIG. 4C, as a result, the detecting piece 44 is elastically deformed as shown in FIG. 4C from the position shown in FIG. 4B and the magnet 45 separates from the magnetoelectric transducing element 46.

Therefore, the electric output of the magnetoelectric transducing element 46 by the movement of the magnet 45 can be detected as the ink amount in the subtank 6.

Figure 5A:
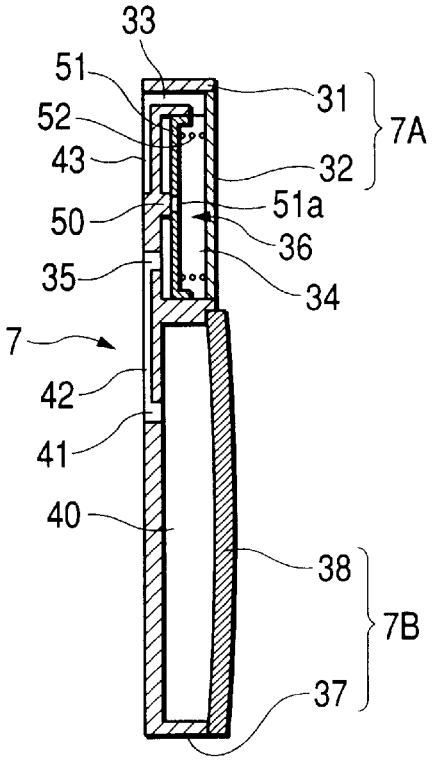
FIGS. 5A and 5B are sectional views for explaining the operation of the subtank in the ink-jet recording apparatus equivalent to the embodiment of the invention.
Figure 5B:
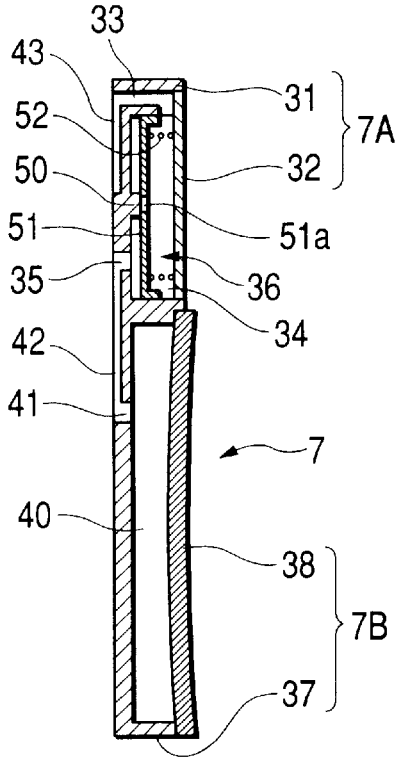

Next, referring to FIGS. 2, 3A to 3D, 4A to 4C, 5A and 5B, an ink supply method (the supply of ink from the main tank to the recording head) of the ink-jet recording apparatus equivalent to this embodiment will be described. FIGS. 5A and 5B are sectional views for explaining the operation of the subtank in the ink-jet recording apparatus equivalent to this embodiment of the invention.

First, as shown in FIG. 2, when the ink pack 24 in the main tank 9 is pressurized by the pneumatic pump 21, ink in the ink pack 24 flows into the lower tank 7B (the ink chamber 40) in the subtank 7 from the ink inlet 39 through the ink supply tube 10.

In this case, when pressure varies in ink in the ink supply tube 10, the tank wall 38 is elastically deformed according to the variation of the pressure and the volume of the lower tank 7B varies. That is, when the variation of the pressure of ink is large, the tank wall 38 is elastically deformed on the side (on the outside) on which the internal volume (pressure) of the ink chamber 40 is increased as shown in FIG. 5A and the variation of the volume (the pressure) is absorbed. In the meantime, when the variation of the pressure of ink is small, the tank wall 38 is elastically deformed on the side (on the inside) on which the internal volume of the ink chamber 40 is reduced as shown in FIG. 5B and the variation of the volume is absorbed.

Hereby, the variation of pressure caused in ink in the ink supply tube 10 has no effect upon the jetting of an ink droplet from the recording head 6.

Next, when negative pressure is generated to form a meniscus in the recording head 6, the check valve 36 is opened, ink in the ink chamber 40 flows into the first ink passage 42 from the distribution port 41 and ink in the first ink passage 42 flows into the ink chamber 34 of the upper tank 7A from the distribution port 35.

Ink in the ink chamber 34 flows into the second ink passage 43 from the ink outlet 33 through the through hole 51*a* and flows into the recording head 6 from the second ink passage 43.

As described above, ink is supplied to the recording head 6 from the main tank 9 via the ink supply tube 10 and the subtank 7.

Therefore, in this embodiment, as ink can be supplied to the recording head 6 according to the closed type ink supply method, no bubble is included in ink in the subtank 7 when ink is supplied as heretofore, a degree of the deaeration of ink is guaranteed and satisfactory printing can be realized.

Also, in this embodiment, as ink can be supplied from the subtank 7 to the recording head 6 by negative pressure provided on the side of the recording head, the height of the subtank 7 can be reduced and the whole subtank can be miniaturized.

In addition, in this embodiment, as a position in height of the recording head 6 for the main tank 9 is not required to be considered strictly because of structure that ink from the main tank 9 is supplied to the subtank 7 by pressure by the pump and ink from the subtank 7 is directly (not via the tube) supplied to the recording head 6, a design freedom in the layout of components can be enhanced.

Also, in this embodiment, as it reduces a constraint on laying the tube (the ink supply tube) that the position in height of the recording head 6 is not required to be considered strictly, a design freedom in setting the outside dimension of the tube (the dimension of the length and the dimension of the diameter) can be also enhanced.

Also, in this embodiment, the detection of the ink amount is described using hall element, however, the invention is not limited to this and the ink amount can be also detected using a position (a distance) sensor.

In this embodiment, the case that ink is supplied from the main tank 9 to the subtank 7 by the pneumatic pump 21 outside the ink supply tube 10 is described, however, the invention is not limited to this and ink may be also supplied from the main tank 9 to the same subtank 7 as the above-mentioned subtank 7 by a pump arranged on the way of the ink supply tube 10.

Referring to FIGS. 6 to 9, a second embodiment of the invention will be described below.

Figure 6:
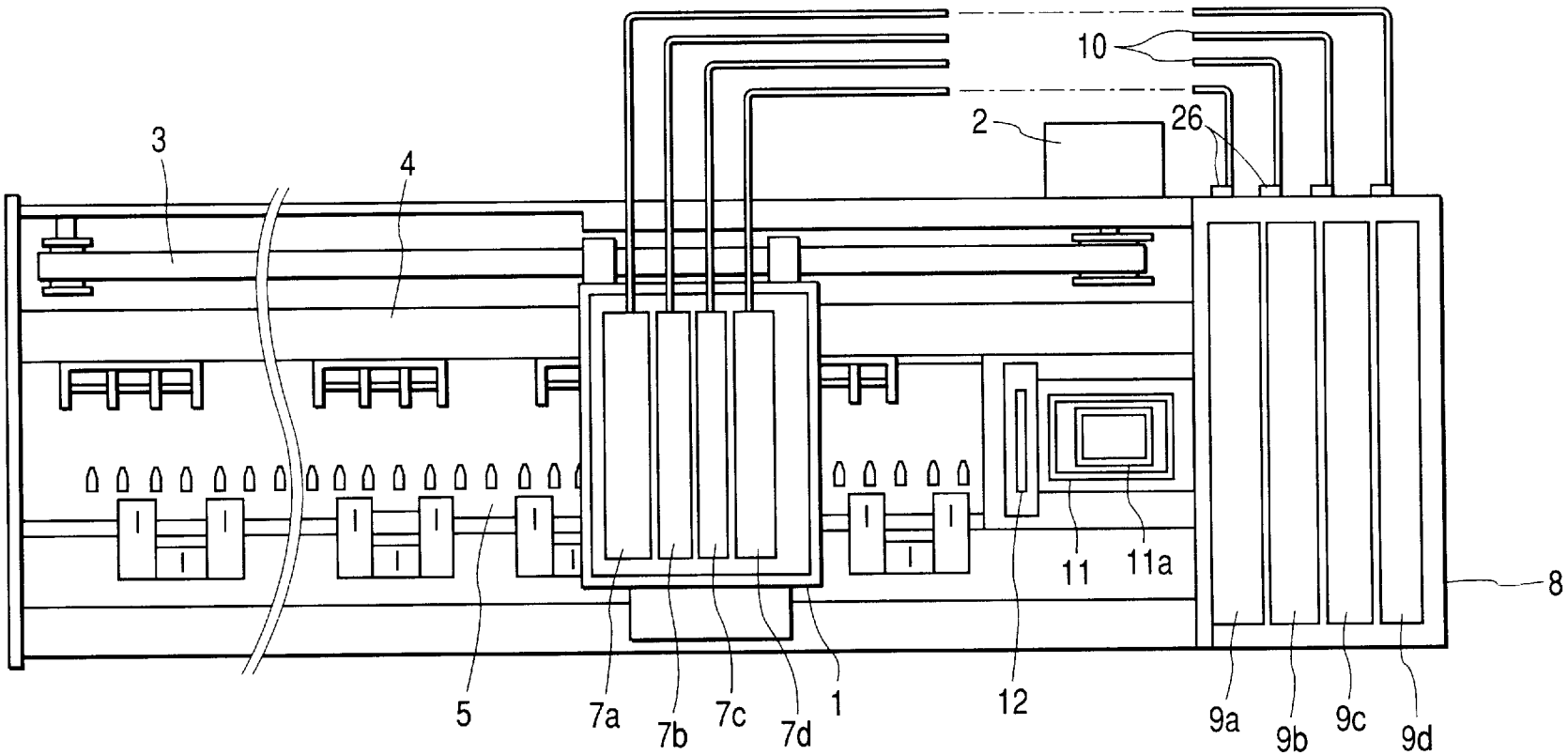
FIG. 6 is a plan view showing the basic configuration of an ink-jet recording apparatus equivalent to a second embodiment of the invention.
Figure 7:
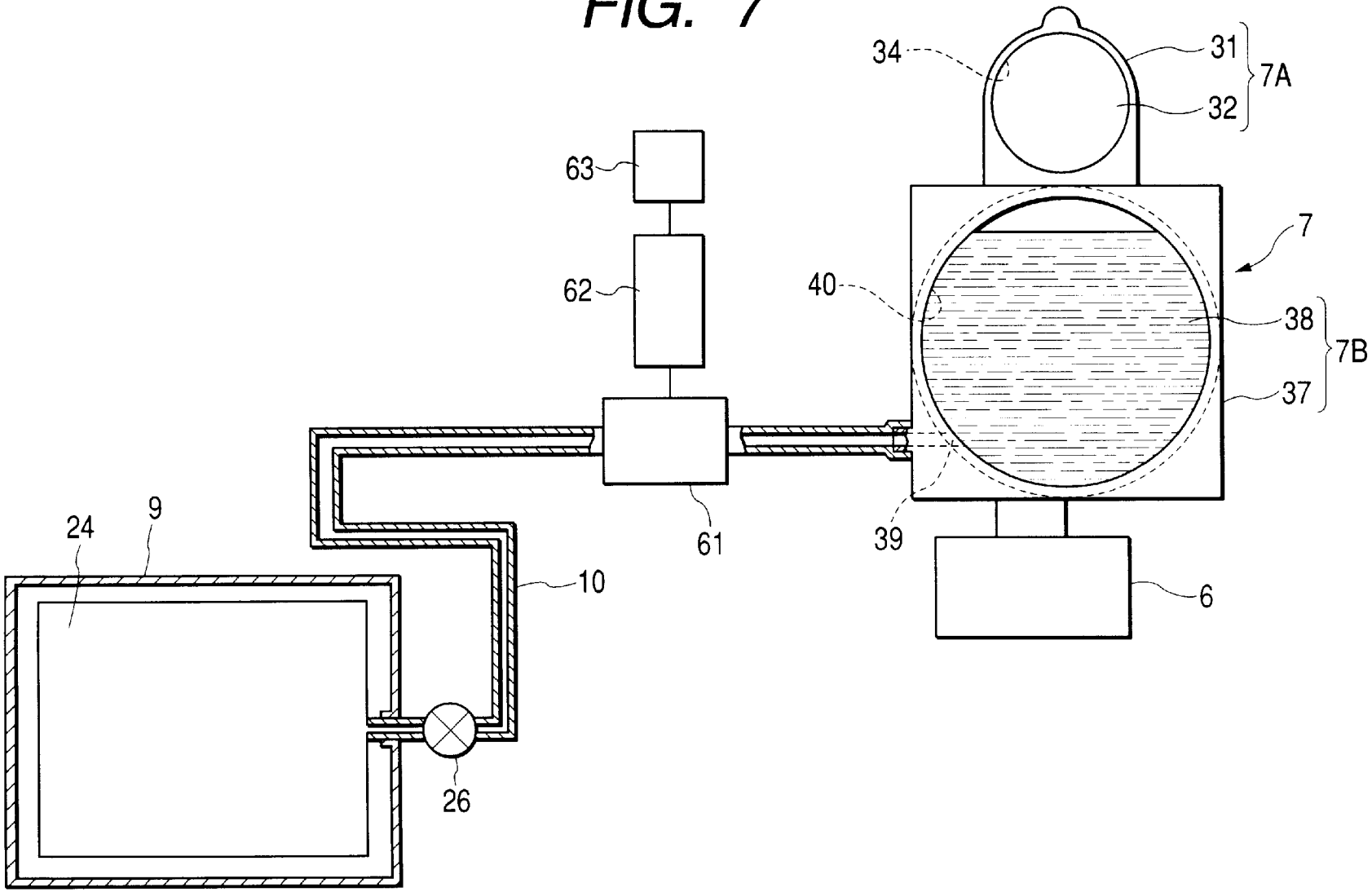
FIG. 7 is a schematic drawing showing an ink supply system from an ink cartridge to a recording head in the recording apparatus shown in FIG. 6.
Figure 8A:
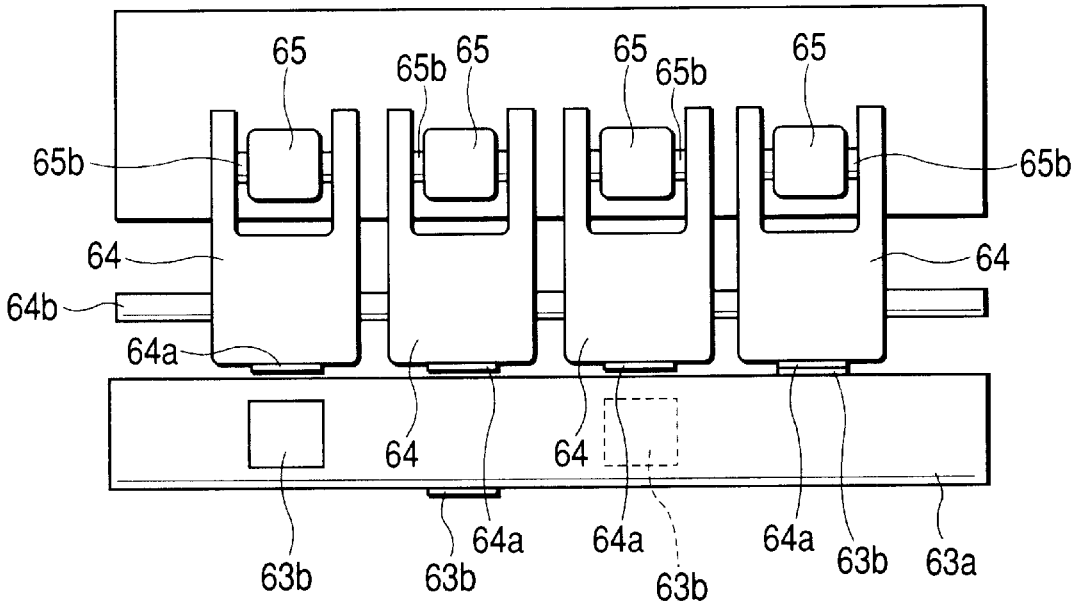
FIGS. 8A and 8B are respectively a plan view and a front view showing diaphragm pumps and pump drivers in the ink supply system.
Figure 8B:
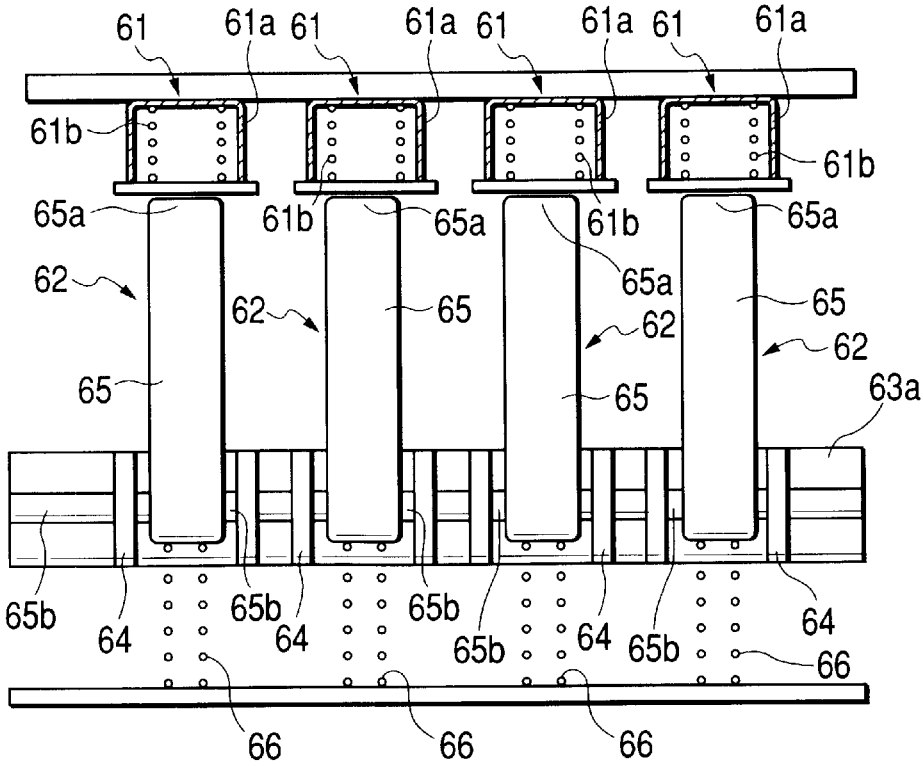
Figure 9:
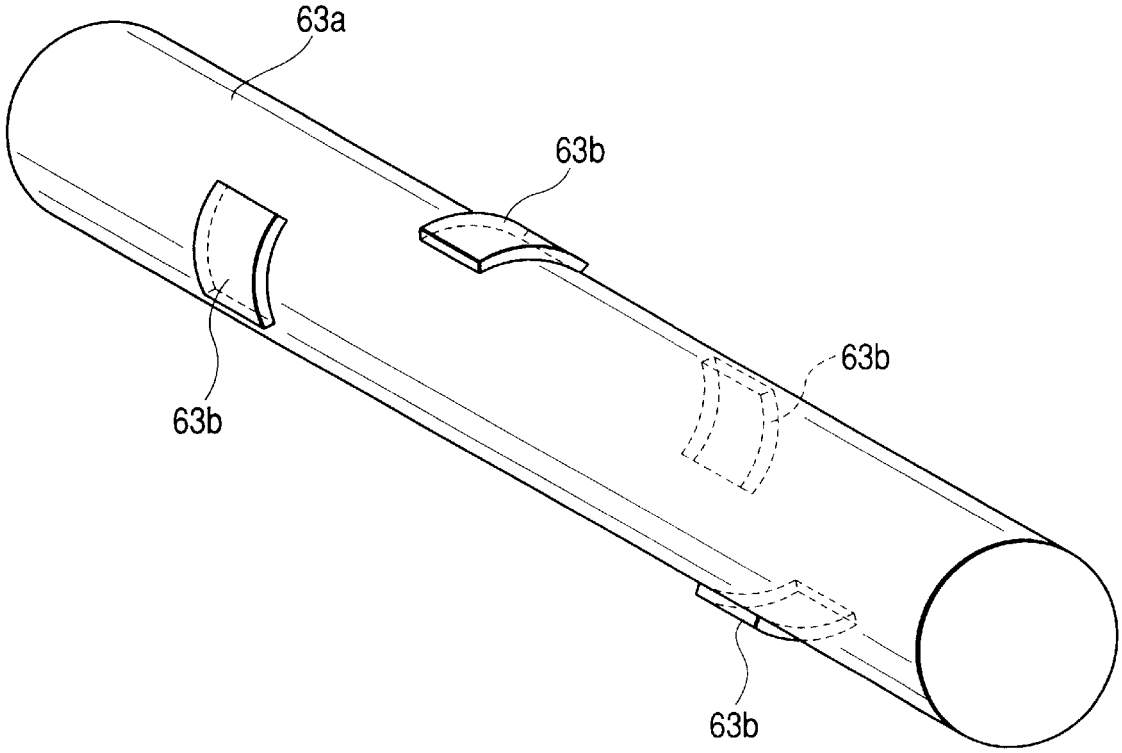
FIG. 9 is a perspective view showing a rotation shaft (a driving shaft) in the pump driver shown in FIGS. 8A and 8B.

First, FIG. 6 is a plan view showing the basic configuration of an ink-jet recording apparatus equivalent to the second embodiment, is similar to FIG. 1 except that the pneumatic pump, the pressure regulating valve and the pressure detector in the above-mentioned embodiment are not provided, the same reference number is allocated to the same member as that shown in FIG. 1 and the detailed description is omitted. FIG. 7 is a sectional view schematically showing the configuration of an ink supply system in the recording apparatus shown in FIG. 6. FIGS. 8A and 8B are respectively a front view and a plan view showing a diaphragm pump and a pump driver in the ink supply system and FIG. 9 is a perspective view showing a rotation shaft (a driving shaft) in the pump driver shown in FIGS. 8A and 8B. In FIGS. 7 to 9, the same reference number is allocated to the same member as that shown in FIG. 6 and the detailed description is omitted.

As shown in FIGS. 7, 8A and 8B, the diaphragm pump shown by a reference number 61 is composed of a circular cylinder 61*a* extended or contracted in the axial direction and a compression coil spring 61*b* that returns the circular cylinder 61*a*, and four diaphragm pumps are arranged corresponding to main tanks 9 (subtanks 7) on the way of the ink supply tube 10.

The circular cylinder 61*a* is provided with a valve (not shown) for sucking ink from the main tank 9 and discharging the ink into the subtank 7.

The end of each compression coil spring 61*b* is resiliently attached in the circular cylinder 61*a*.

The diaphragm pump 61 is provided with a function that increases or decreases the internal volume (the internal volume of the pump) of the circular cylinder 61*a* by the extension or the contraction of the compression coil spring 61*b* by driving by a pump driver described later, sucks and discharges ink from an ink pack 24 in each main tank 9 and supplies it to each subtank 7. The diaphragm pump is configured so that the above-mentioned ink amount detecting device detects that the ink amount in the subtank 7 is equal to or smaller than a predetermined volume, ink (arbitrary ink the volume of which is equal to or smaller than the predetermined volume) is selected and new ink is supplied.

Four pump drivers 62 for driving each diaphragm pump 61 are arranged in the recording apparatus. Each pump driver 62 uses a drive motor 63 provided with a rotation shaft 63*a* selectively coupled to the diaphragm pump for driving the diaphragm pump 61 for a pump driving source. Each pump driver 62 is provided with a first link 64 having an intermittent gear 64*a* on the driven side at the end edge on one side of the link and a second link 65 for increasing or decreasing the internal volume of the circular cylinder 61*a* depending upon a turned/swung position of the link.

The drive motor 63 is formed by a stepping motor the normal rotation and the reverse rotation of which are enabled or a DC motor and is connected to a controller (not shown). The drive motor is driven according to the control of the controller based upon detection by the ink amount detecting device described later. On the outer surface of the rotation shaft 63*a*, four intermittent gears 63*b* on the driving side as a coupling member that can be selectively engaged with the intermittent gear 64*a* of the first ink 64 in each pump driver 62 are provided. These intermittent gears 63*b* are arranged at a predetermined interval in the circumferential direction and in the axial direction of the rotation shaft 63*a* as shown in FIG. 9.

The first link 64 is arranged so that it can be turned with a pivot part 64*b* in the center of turning around the rotation shaft 63*a*. The second link 65 is provided with an operating part 65*a* for pressing the circular cylinder 61*a* in a direction in which the circular cylinder is contracted and is coupled to the end on the side reverse to the end on the gear formation side of the first link 64 so that the second link can be turned/swung with a pivot part 64*c* (a pivot part 65*b*) in the center of turning. The pivot part 64*c* (a coupling member) is urged in a direction in which both links 64 and 65 approach the circular cylinder 61*a* by a compression coil spring 66. A long hole 65*c* extended in the longitudinal direction of the link is made in the second link 65. The turning/swing is regulated by fitting a securing pin 67 located in the recording apparatus into the long hole 65*c*.

Next, referring to FIGS. 7 to 10D (including FIGS. 10A to 10C), an ink supply method (the supply of ink from the main tank to the subtank) of the ink-jet recording apparatus equivalent to the second embodiment will be described. FIGS. 10A to 10D are front views for explaining the operation of the diaphragm pump and the pump driver in the ink-jet recording apparatus equivalent to the second embodiment of the invention.

This ink supply method includes "pump selecting operation" and "pump driving operation", which will be sequentially described below. Each process is executed by a specific pump driver corresponding to a case that the ink amount in the subtank decreases.

Pump Selecting Operation

Figure 10A:
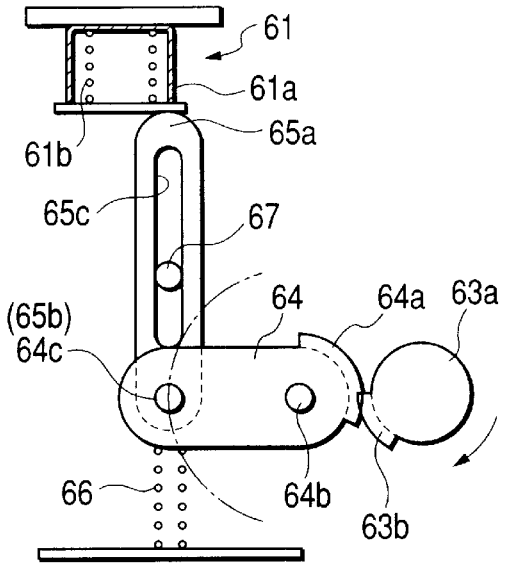
FIGS. 10A to 10D are front views for explaining the operation of the diaphragm pump and the pump driver in the ink-jet recording apparatus equivalent to the second embodiment of the invention.

First, when the ink amount in the subtank 7 decreases, a detecting piece 44 of the ink amount detecting device detects the variation of the volume (pressure) and the turning of the rotation shaft 63*a* is started in a direction of normal rotation (clockwise) shown by an arrow in FIG. 10A by the rotation of the drive motor 63 from an initial state of pump selection shown in FIG. 10A.

In this case, as the intermittent gear 63*b* of the rotation shaft 63*a* is engaged with the intermittent gear 64*a* of the first link 64 as shown in FIG. 10A when the turning of the rotation shaft 63*a* is started clockwise, the turning of the first link 64 is started counterclockwise around the pivot part 64*b* as the center of rotation and the turning of the second link 65 is started counterclockwise with the pivot part 65*b* in the center.

Figure 10C:
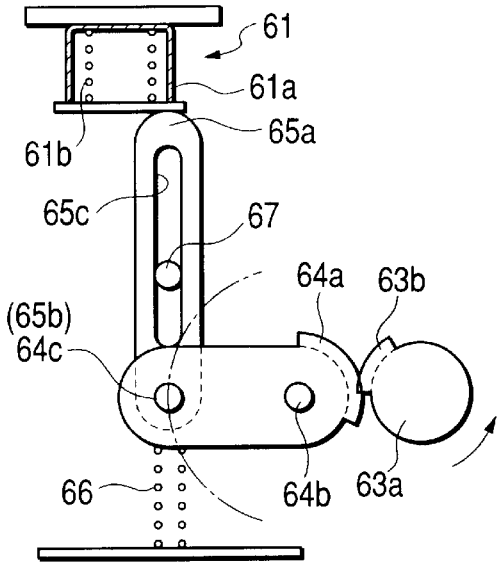
Figure 10B:
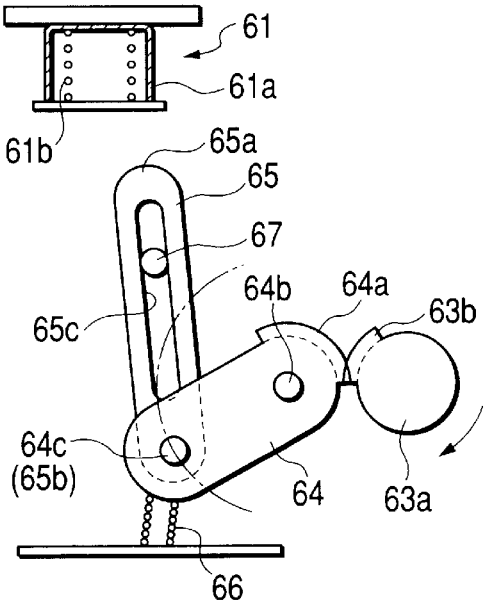

When the rotation shaft 63*a* is further turned clockwise by the driving of the drive motor 63 from this state, the first link 64 is further turned counterclockwise with the pivot part 64*b* in the center as shown in FIG. 10B. As a result, the second link 65 is swung, being turned counterclockwise with the pivot part 65*b* in the center, being regulated by the pin 67.

In this case, as the operating part 65*a* is displaced downward and separates from the circular cylinder 61*a* when the second link 65 is swung, being turned counterclockwise, operating force from the second link 65 (the operating part 65*a*) does not act upon the circular cylinder 61*a* and the internal volume of the circular cylinder 61*a* does not vary (does not increase or decrease).

When the rotation shaft 63*a* is further turned clockwise by the driving of the drive motor 63, engagement between the intermittent gear 63*b* of the rotation shaft 63 and the intermittent gear 64*a* of the first link 64 is released and the first and second links 64 and 65 are both returned to respective initial positions by the spring of the compression coil spring 66. Hereby, an arbitrary diaphragm pump 61 corresponding to both tanks 7 and 9 (ink required to be supplied to the subtank 7) is selected.

Pump Driving Operation

First, after the pump is selected, the turning of the rotation shaft 63*a* is started in a reverse direction shown by an arrow in FIG. 10C (counterclockwise) by the rotation of the drive motor 63 from an initial state of pump driving shown in FIG. 10C.

In this case, as the intermittent gear 63*b* of the rotation shaft 63*a* is engaged with the intermittent gear 64*a* of the first link 64 as shown in FIG. 10C when the turning of the rotation shaft 63*a* is started counterclockwise, the turning of the first link 64 is started clockwise with the pivot part 64*b* in the center and the turning of the second link 65 is started counterclockwise with the pivot part 65*b* in the center.

When the rotation shaft 63*a* is further turned counterclockwise by the driving of the drive motor 63 from this state, the first link 64 is further turned clockwise with the pivot part 64*b* in the center. As a result, the second link 65 is swung, being turned counterclockwise with the pivot part 65*b* in the center, being regulated by the pin 67.

Figure 10D:
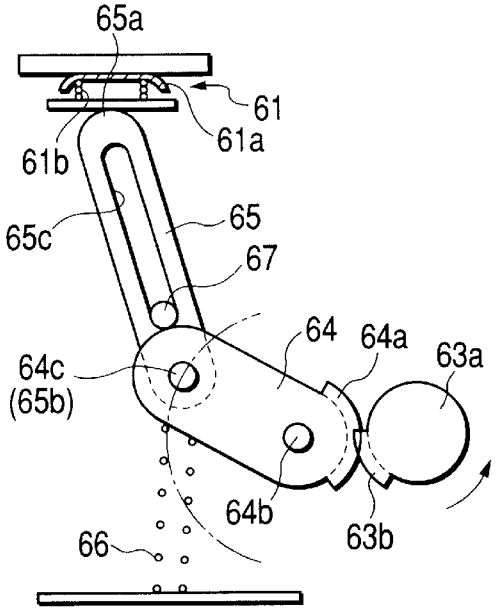

In this case, as the operating part 65*a* is displaced upward and presses the circular cylinder 61*a* in the axial direction (upward) when the second link 65 is swung, being turned counterclockwise, the circular cylinder 61*a* is moved in a direction in which the circular cylinder is contracted against the spring of the compression coil spring 61*b* as shown in FIG. 10D. Hereby, as the internal volume of the circular cylinder 61*a* decreases and pump discharging operation is executed, ink in the circular cylinder 61*a* is discharged (supplied) to the subtank 7.

When the rotation shaft 63*a* is turned clockwise by the driving of the drive motor 63 from this state, the first link 64 is turned counterclockwise with the pivot part 64*b* in the center. As a result, the second link 65 is swung, being turned clockwise with the pivot part 65*b* in the center, being regulated by the pin 67.

In this case, as the operating part 65*a* is displaced downward and pressure upon the circular cylinder 61*a* is released when the second link 65 is swung, being turned clockwise, the circular cylinder 61*a* is moved in a direction in which it is extended by the spring of the compression coil spring 61*b* as shown in FIG. 10C. Hereby, as the internal volume of the circular cylinder 61*a* is increased and pump sucking operation is executed, ink is sucked (supplied) in the circular cylinder 61*a* from the main tank 9.

When the rotation shaft 63*a* if further turned clockwise by the driving of the drive motor 63, engagement between the intermittent gear 63*b* of the rotation shaft 63*a* and the intermittent gear 64*a* of the first link 64 is released and the first and second links 64 and 65 are returned to respective initial positions by the spring of the compression coil spring 66.

As described above, ink from the main tank 9 is supplied to the subtank 7 requiring the supply of ink via the diaphragm pump 61 by the pump selecting operation and the pump driving operation.

Therefore, in the second embodiment, as the ink pack and the valve which the supply of ink from the main tank 9 to the subtank 7 heretofore required are not required, the number of controlled elements can be reduced and the control system can be simplified.

Also, in the second embodiment, as it does not require the structure resistant to pneumatics of the ink pack and the formation of the pressure chamber in the main tank that the ink pack is not required, the structure of the main tank can be also simplified.

Further, in the second embodiment, as it reduces the outer dimension of the main tank that the pressure chamber is not required in the main tank, the whole apparatus can be miniaturized.

In addition, in the second embodiment, as the motor is not required every diaphragm pump, the number of parts can be reduced, the whole structure can be simplified and the cost can be reduced.

Also, in the second embodiment, as the selection and the driving of each diaphragm pump 61 can be realized by the normal rotation and the reverse rotation of the motor 63 because the motor 63 is formed by the motor the normal rotation and the reverse rotation of which are enabled, the prompt supply of ink from each main tank 9 to each subtank 7 can be realized.

In the second embodiment, the case that the four diaphragm pumps 61 and the four pump drivers 62 are provided is described, however, the invention is not limited to this and the number can be suitably changed according to the number of main tanks (subtanks).

As clear from the above description, according to the ink-jet recording apparatus and its ink supply method according to the invention, satisfactory printing can be realized and the whole subtank can be miniaturized.

What is claimed is:

1. An ink-jet recording apparatus comprising:

a reciprocating carriage;

a recording head mounted on the carriage for jetting an ink droplet corresponding to print data;

a main tank for supplying ink to the recording head; and a subtank mounted on the carriage and connected to the main tank and the recording head, the subtank including an upper tank having an ink outlet for leading ink to the recording head, and a lower tank communicating with the upper tank and having an ink inlet for leading ink from the main tank by pressure of a pump, wherein the lower tank is elastically deformable according to variation of an internal pressure thereof.

2. An ink-jet recording apparatus according to claim 1, wherein at least a part of a tank wall formed on the lower tank is made of an elastic film.

3. An ink-jet recording apparatus according to claim 2, wherein the elastic film is formed by a material which is flexible, resistant to ink and impermeable to moisture and gas.

4. An ink-jet recording apparatus according to claim 1, further comprising a check valve arranged in the upper tank and opened by negative pressure provided on a side of the recording head.

5. An ink-jet recording apparatus according to claim 1, further comprising an ink amount detecting device detectable an ink amount in the subtank based upon an amount of elastic deformation thereof.

6. An ink-jet recording apparatus according to claim 1, wherein pneumatics generated by a pneumatic pump are applied to the main tank so that ink is supplied to the main tank to the subtank.

7. An ink-jet recording apparatus according to claim 1, wherein a diaphragm pump is provided at an intermediate position between the main tank and the subtank for supplying ink from the main tank to the subtank according to increase or decrease of an internal volume of the diaphragm pump.

8. An ink-jet recording apparatus according to claim 7, wherein a plurality of the main tanks, a plurality of the subtanks and a plurality of the diaphragm pumps are provided.

9. An ink-jet recording apparatus according to claim 8, further comprising a plurality of pump drivers, each of which has a link mechanism corresponding to the diaphragm pumps, wherein the pump drivers are driven by a common motor having a rotation shaft for selectively driving each diaphragm pump.

10. An ink-jet recording apparatus according to claim 9, wherein coupling members provided to an outer surface of the rotation shaft and are selectively coupled to the link mechanisms of the pump drivers.

11. An ink-jet recording apparatus according to claim 10, wherein the coupling members are arranged at a predetermined interval in a circumferential direction and an axial direction of the rotation shaft.

12. An ink-jet recording apparatus according to claim 11, wherein each coupling member of the rotation shaft is provided as a driving intermittent gear; and the link mechanism of each pump driver includes a driven intermittent gear corresponding to each driving intermittent gear.

13. An ink-jet recording apparatus according to claim 12, the link mechanism including a first link arranged in a direction of the outside diameter of the rotation shaft so as to be turned and having the driven intermittent gear at one end of the first link; and a second link turnably and swingably coupled to another end of the first link where the driven intermittent gear is not provided, wherein an internal volume of the diaphragm pump is increased or decreased in accordance with a turning and swing of the second link; and a common pivot part of the second link and the first link is urged by a spring in a direction in which the common pivot part approaches the diaphragm pump.

14. An ink-jet recording apparatus according to claim 13, further comprising a pin for regulating the turning and the swing of the second link.

15. An ink-jet recording apparatus according to claim 14, further comprising a long hole fitted to the pin provided to the second link.

16. An ink-jet recording apparatus according to claim 9, wherein the motor is rotatable in both the normal and reverse directions of rotation.

17. An ink-jet recording apparatus according to claim 16, wherein the diaphragm pump is selectively driven by the normal or reverse rotation of the motor to thereby supply ink from the main tank to the subtank.

18. A method for supplying ink from a main tank to a recording head via a subtank of an ink-jet recording apparatus provided with a reciprocating carriage, a recording head mounted on the carriage for jetting an ink droplet corresponding to print data, a main tank for supplying ink to the recording head and a subtank mounted on the carriage while connected to the main tank and the recording head, and having an upper tank and a lower tank mutually communicating therebetween, wherein when ink is supplied from the main tank to the recording head, the lower tank is elastically deformable according to a variation of internal pressure thereof.

19. An ink supply method of an ink-jet recording apparatus according to claim 18, wherein a pneumatic pump is arranged in the main tank; and pneumatics generated by the pneumatic pump are applied to the main tank so that ink is supplied to the main tank to the subtank.

20. An ink supply method of an ink-jet recording apparatus according to claim 18, wherein a diaphragm pump is provided at an intermediate position between the main tank and the subtank for supplying ink from the main tank to the subtank according to increase or decrease of an internal volume of the diaphragm pump.

* * * * *